United States Patent [19]

Ampt et al.

[11] 4,117,315

[45] Sep. 26, 1978

[54] RADIOACTIVE DOSE CALCULATING DEVICE

[75] Inventors: Cornelis Georg Frederik Ampt, Voorburg; Keimpe Klaas Keimpema, Zoetermeer, both of Netherlands

[73] Assignee: De Staat der Nederlanden, Te Dezen Vertegenwoordigd Door de Directeur-Generaal der Posterijen, Telegrafie en Telefonie, The Hague, Netherlands

[21] Appl. No.: 766,246

[22] Filed: Feb. 7, 1977

[30] Foreign Application Priority Data

Dec. 2, 1976 [NL] Netherlands ..... 7601448

[51] Int. Cl.[2] ..... G06C 3/00; G06C 1/02

[52] U.S. Cl. ..... 235/88 R; 235/70 A; 235/78 R

[58] Field of Search ..... 235/88 R, 78 R, 70 A, 235/70 R, 84, 116

[56] References Cited

U.S. PATENT DOCUMENTS

| | | | |
|---|---|---|---|
| 2,484,366 | 10/1949 | Wilson | 235/88 |
| 2,550,458 | 4/1951 | Dresher | 235/88 |
| 3,232,531 | 2/1966 | Hodge, Jr. | 235/84 |
| 3,700,162 | 10/1972 | Gaggero et al. | 235/78 |
| 3,757,092 | 9/1973 | Miller | 235/88 |
| 4,037,782 | 7/1977 | Jackson | 235/84 |

*Primary Examiner*—Stephen J. Tomsky
*Attorney, Agent, or Firm*—Hugh Adam Kirk

[57] ABSTRACT

Calculating device provided with scales for calculating radioactive doses and intensities, in which the scales are arranged for calculating the product of the intensity in a radioactive area at a given instant and a dose factor to be determined by experiment. This dose factor depends on the moment when the contaminated area is entered and on the time spent in the area.

6 Claims, 4 Drawing Figures

FIG. I
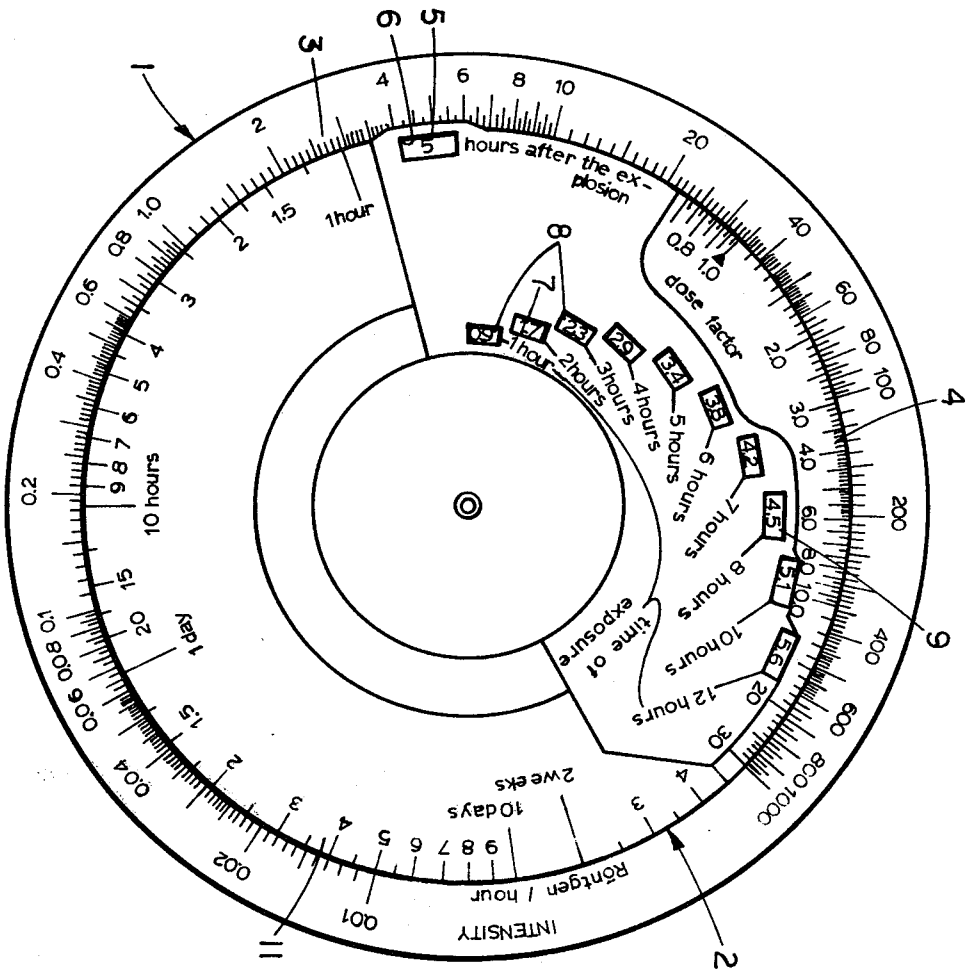
FIG. II
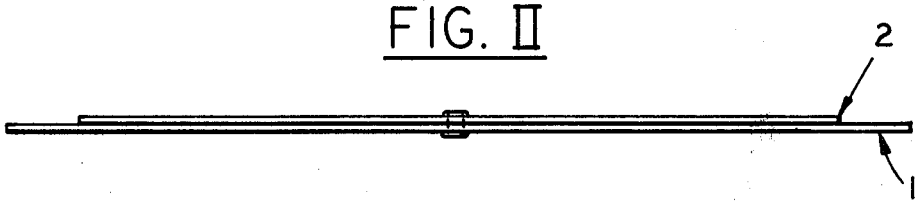

FIG. III
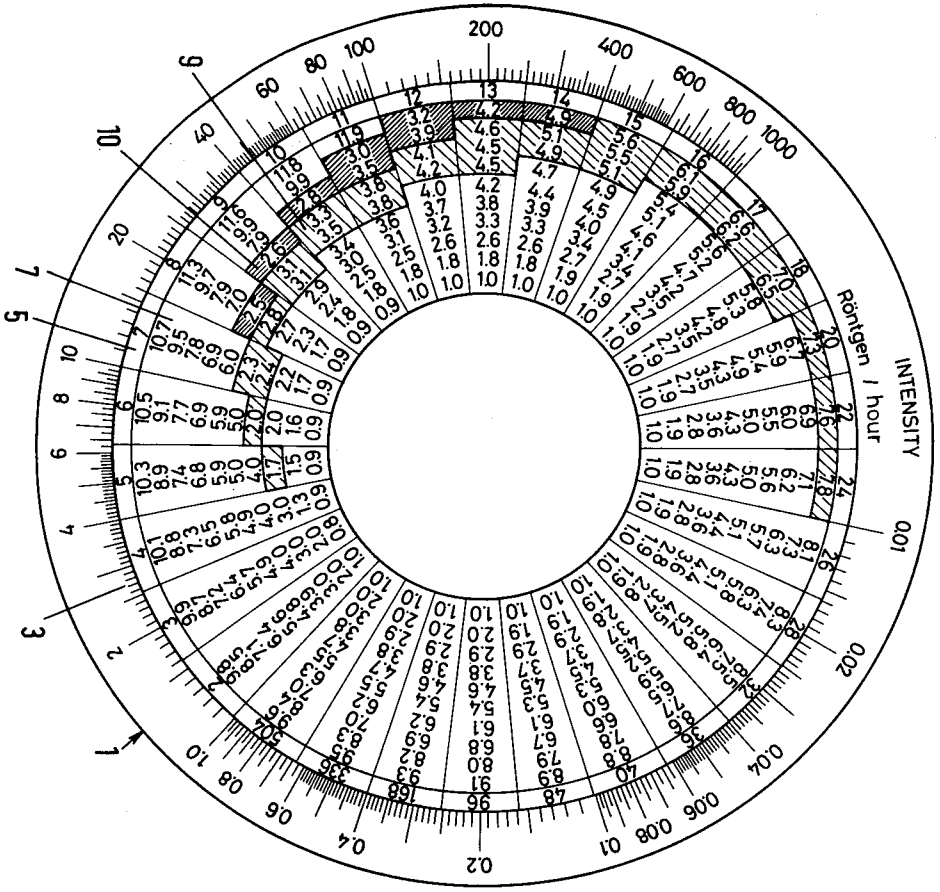

FIG. IV
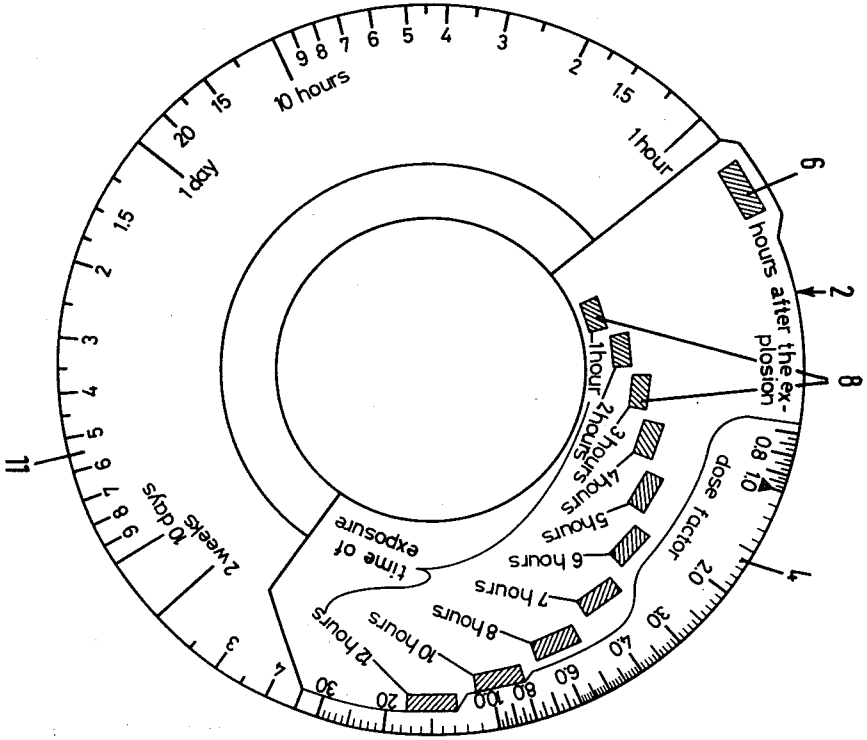

RADIOACTIVE DOSE CALCULATING DEVICE

BACKGROUND OF THE INVENTION

The invention relates to a calculating device provided with scales for calculating radioactive doses and intensities. By dose is understood the sum of the separate products of intensity and duration of exposure.

A calculating device of this kind is known from an article by B. W. Soole, entitled "The RADIAC slide rule for the computation of external radiation dose from nuclear fission products", Journal of Scientific Instruments, June 29, 1952, pp. 189 - 192.

The known calculating device is based on the following concept. After a nuclear explosion which has released radioactive materials, radioactive radiation decreases with time. This decrease can be approximated by the formula $I_t = I_1 \cdot t^{-x}$, where $I_t$ is the intensity a period of time $t$ after the explosion, $I_1$ the intensity one hour after the explosion, $t$ the time elapsed after the explosion and $x$ a decay exponent, for which 1.2 is a practical value.

Hitherto all calculating devices of this kind have been based on the aforementioned value of $x = 1.2$. The actual value of $x$, however, is influenced by the conditions under which the explosion takes place and also by the properties and the composition of the source of explosion; therefore it will generally deviate from the value 1.2. If the approximation formula given above is used, an insight is required into the variations that may arise from an exponent $x$ differing from the average value 1.2. The magnitude of the deviation can be determined by computation for different values of $x$. To achieve a good approximation, a simpler working method, and a greater accuracy in calculating a different approximation formula should be used in which a deviation from the value 1.2 for the decay exponent has not such a preponderant influence.

SUMMARY OF THE INVENTION

According to the invention the scales of the calculating device are arranged for calculating the product of the intensity in a radioactive area at a given instant and a dose factor to be determinated by experiment. This dose factor depends on the moment when the contaminated area is entered and on the time spent in the area. By means of a calculating device which considers these factors, the dose to be expected can be immediately determined with a high degree of accuracy. A table of dose factors occurring with several different durations of exposure for different times of entry can easily be drawn up and incorporated in the calculating device, thereby taking into account deviations in the exponent $x$ from the value 1.2. For example in the case of a radiation intensity I and a very short exposure V the dose $D = I.V$. However as the exposure time V increases, the value for D becomes too high. In the case of $V = 0.2\ t_m$ — where $t_m$ is the time between the explosion and the moment when the radiation intensity is measured — the value obtained with the formula $D = I.V$ is 10% too high, based upon $x$ having its value = 1.2.

According to this invention, the scales of the calculating device are so arranged that the following formula is satisfied:

$$D = I_m \cdot V \frac{a \cdot t_m + b \cdot V}{c \cdot t_m + d \cdot V}.$$

In this formula D is the dose, $I_m$ the intensity measured, $V$ the duration of exposure, $t_m$ the time between the explosion and the measurement, and $a$, $b$, $c$ and $d$ are constants.

For exposure times $V < t_m$ the scales of the calculating device can be so arranged that $$a = 2$$

$$b = 0$$

$$c = 2$$

$$d = 1.$$

If this condition is satisfied, the invention provides a simple approximation formula, which can often be worked out mentally, so that the results obtained by means of the calculating device can easily be checked.

If $V < 2.6\ t_m$ the result is always too high, the maximum upward deviation being approx. 3% for $V \approx 0.85\ t_m$.

If $V > 2.6\ t_m$ the result is always too low, the deviation increasing as V increases. For $V \approx 4.5\ t_m$ the result is approx. 4% too low.

The fall-out is not complete until four hours or more after the explosion. This implies that if the contaminated area is entered immediately, after a radiation intensity measurement the result obtained with the aforementioned values of $a$, $b$, $c$ and $d$ will be sufficiently accurate, at least for the first 18 hours, provided the exponent $x$ has a value of 1.2. For immediate entry and a comparatively short exposure, e.g. for carrying out repairs, the aforementioned values for $a$, $b$, $c$, and $d$ give a very good result. If the exposure time $V > 4\ t_m$, these values are no longer usable. If, according to the invention, the scales of the calculating device are so arranged that $$a = 100$$

$$b = 1$$

$$c = 100$$

$$d = 50,$$

the formula can be used for the whole range of V. The result thus obtained with the aid of the device is somewhat less simple to check. In the case of the prior art device, however, checking is hardly possible. With the last-mentioned values $a$, $b$, $c$ and $d$, the result is about accurate for $V \approx 4.6\ t_m$ and $V \approx 35.4\ t_m$ and too low for intermediate values of V, a maximum value of approx. -4.7% occurring when $V \approx 15\ t_m$, on the understanding again that the decay exponent $x$ has a value 1.2.

If $V < 4.6\ t_m$ the result is too high, the maximum deviation being approx. 4% for $V \approx t_m$. With longer exposures, $V > 35\ t_m$, the results — being too high — are always on the safe side, the deviation increasing as $V$ increases. For $V = 48\ t_m$ the deviation is approx. 5% (condition: $x = 1.2$). In other words: at a measuring time $t_m$ (expressed in hours) after the explosion, the last-mentioned values for *a, b, c* and *d* allow an estimation of the dose for a period twice as long.

The invention can be embodied in a slide rule, which may be straight or circular. The desired results can also be realized by means of an electronic calculator.

BRIEF DESCRIPTION OF THE VIEWS

The above mentioned and other features, objects and advantages, and a manner of attaining them are described more specifically below by reference to an embodiment of this invention shown in the accompanying drawings wherein:

FIG. 1 is a plan view of a circular slide rule according to one embodiment of the present invention;

FIG. II is an edge view of the rule shown in FIG. 1;

FIG. III is a plan view of the lower disc shown in FIG. I with all of the scales marked thereon; and FIG. IV. is a plan view of the upper disc shown in FIG. I showing two scales on the periphery thereof and the windows therein.

DETAILED DESCRIPTION OF A PREFERRED EMBODIMEHT

The drawing represents by way of example a circular slide rule embodiment based on the latter values for *a, b, c* and *d*, FIGS. I and II showing the two parts 1 and 2 superimposed and axially pivoted together to form the rules.

Part 1 (FIGS. I and III) has a first scale 3 for the intensity in röntgen per hour. Scale 3 is used in combination with a (second) scale 4 on part 2 FIGS. I and IV for the dose factor. A (third) scale 5 on part 1 represents the time in hours after the explosion. It is used in combination with a window 6 in part 2. A (fourth) scale 7 on part 1 is marked with dose factor values, which can be read through windows 8 in part 2. Each window has a legend showing a different duration of exposure in hours.

The fourth scale 7 is divided into three parts, viz., a large part for possible maximum deviations –further called errors —of less than 6.5%, a smaller part 9 for errors between 6.5 and 15% and a very small part 10 for errors of more than 15%. Parts 9 and 10 are sparsely and closely hatched, respectively. In a practical embodiment the three parts mentioned have different colours, e.g. green, orange and red.

The circumference of disc 2 is provided with a (fifth) scale 11, a time scale used in combination with scale 3 on disc 1. The combined use of two such scales is known in itself from Soole's aforementioned article. The scales 3 and 11 make it possible to determine the intensity at another moment than that of the measurement.

Some examples illustrating how the device can be employed are given below.

a. Measurement and immediate entry. Short exposure in comparison with the length of time elapsed since the explosion.

| | |
|---|---|
| Intensity | 14 R/h |
| Time of measurement | 5 hours after the explosion |
| Desired time of exposure | 4 hours |

Read the dose factor for an instant five hours after the explosion (window 6) and an exposure time of four hours (one of the windows 8). Dose factor 2.9 green, error <6.5%, even in the case of an extreme decay deviation (see FIG. 1). Set Δ (index of dose factor scale 4) in register with 14 R/h on intensity scale 3, and read the dose on this scale 3 opposite 2.9 on dose factor scale 4. Dose to be expected: 40 R, error $< + 2\frac{1}{2}$ R i.e. $= 40 \times 6.5\%$.

b. Measurement and immediate entry. Long exposure in comparison with the length of time elapsed since the explosion.

| | |
|---|---|
| Intensity | 14 R/h |
| Time of measurement | 5 hours after the explosion |
| Desired time of exposure | 6 hours |

Read the dose factor for a moment five hours after the explosion (window 6) and an exposure time of six hours (one of windows 8). Dose factor 3.8 orange, error < 15% but >6.5% in the case of an extreme decay. Set α (index of dose factor scale) in register with 14 R/h on intensity scale 3 and read the dose on this scale, opposite 3.8 on dose factor scale 4. Dose to be expected: 55 R, error $< + 8.3$ R i.e. $55 \times 15\%$.

c. Measurement and no immediate entry.

| | |
|---|---|
| Intensity | 14 R/h |
| Time of measurement | 5 hours after the explosion |
| Time of entry | 8 hours after the explosion |
| Desired time of exposure | 8 hours |

Set disc 2 so that 5 hours on scale 11 registers with 14 R/h on scale 3 and read the intensity opposite 8 hours on scale 11. The intensity will be 8 R/h on scale 3 in the case of a normal decay. A difference of decay does have some influence now, but the error can be eliminated if a control measurement is carried out immediately before the moment of entry.

With scale 5 set at 8 hours the dose factor is read through the window 8 associated with an exposure time of 8 hours. The dose factor is 5.4 in the green area. This value is very accurate still: the error is <6.5% in the case of an extreme decay.

The dose factor (scale 4) multiplied by the intensity of 8 R/h (from first scale 3 setting above is $5.4 \times 8 = 43$.

Dose to be expected: 43 R.

d. When can the area be entered?

| | |
|---|---|
| Intensity | 100 R/h |
| Time of measurement | 4 hours after the explosion |
| Desired time of exposure | 3 hours |
| Permissible dose | 60 R |

1st approximation. Put the dose factor 1 or Δ on scale 4 opposite or equal to the exposure time = 3on scale 3. Consequently, the intensity will have to fall to 60 on scale 3 (permissible dose) $\div 3 = 20$ R/h on scale 4. To determine the moment when this fall has taken place disc 2 is so set that 4 (hours after the explosion) on scale 11 is opposite 100 R/h on intensity scale 3. Read scale 11 opposite 20 R/h on scale 3. The value read on scale 3 is reached after 16 hours. Further approximation. Now read the dose factor for an instant 16 hours after the explosion (window 6) and an exposure time of three hours (one of windows 8). The dose factor is 2.7. Align the permissible dose of 60 R on intensity scale 3 and the dose factor 2.7 on scale 4 and read opposite Δ (index of dose factor scale). Reading: 22 R/h. This leads to the conclusion that the intensity will have to fall to 22 R/h. Consequently, the area may be entered earlier than was found by the first approximation. To find the correct moment the hours scale 11 is moved once more along the intensity scale 3 till 4 on scale 11 (or 4 hours after the explosion) is in register with 100 (R/h) on scale 3. Read opposite 22 R/h. The value read is obtained 14.5 hours after the explosion. Consequently, the area can be entered when 14.5 hours have elapsed after the explosion in the case of a normal decay. In the meantime a better insight can perhaps be gained in the actual decay exponent. If, however, after approx. 14 hours a meausurement is made and the area entered, the result obtained by means of the slide rule will be reasonably correct, regardless of the actual decay exponent, in view of the long period after the explosion and the short exposure time.

Some advantages of the calculating device according to the invention are:

1. Its use requires little training, so that the time needed for instruction can be reduced to e.g. 10% of the time required with the known RADIAC Slide Rule device mentioned above in the prior art article.
2. Easy reading and small risk of interpolation errors and mistakes.
3. High working speed.
4. Also usable with decay exponent deviations, as especially in case of possibly greater risks, e.g. of slower decay, it gives an indication — by means of a division into classes — of the maximum error to be expected, on the understanding that the area is entered immediately after the measurement.
5. As a result of a greater accuracy of the forecasts, work can possibly be started earlier and risks reduced.
6. Low cost of manufacture in comparison with those of existing means.

While there is described above the principles of this invention in connection with specific apparatus, it is to be clearly understood that this description is made only by way of example and not as a limitation to the scope of this invention.

What we claim is:

1. A device for calculating radioactive doses and intensities comprising:

(A) a first part having:

(a) an outer scale for the intensity of Rontgens per hour, (b) an aligned adjacent inner scale for the time in hours after the explosion, (c) a plurality of aligned further inner scales of different dose factor values divided into three sections having visually different charactertistics for different percentage ranges of errors;

(B) a second part having:

(a) a first scale on an edge thereof for the dose factor cooperating with said intensity scale, (b) a window cooperating with said time scale, (c) a plurality of stepped windows for different exposure times, one corresponding to each scale of dose factor values, and (d) a second scale on said edge thereof for indicating intensity at other times than that of the measurement, and cooperating with said intensity scale, and (C) means for fastening said parts together for relative movement with respect to each other.

2. A device for calculating according to claim 1, characterized in that the scale divisions are so arranged that the formula $$D = I_m \cdot V \frac{a \cdot t_m + b \cdot V}{c \cdot t_m + d \cdot V}$$

is satisfied, in which D is the dose, $I_m$ the intensity measured, $V$ the duration of exposure, $t_m$ the time between the explosion and the measurement and $a$, $b$, $c$ and $d$ are constants.

3. A device for calculating according to claim 2, characterized in that the scale divisions are so arranged that $a = 2$ $b = 0$ $c = 2$ $d = 1.$

4. A device for calculating according to claim 2, characterized in that the scale divisions are so arranged that $a = 100$ $b = 1$ $c = 100$ $d = 50.$

5. A device according to claim 1 wherein said parts are discs of different diameters and said means for fastening said parts comprises a pivot means at the center of said discs.

6. A device according to claim 1 wherein said visually different sections are of different colors.

* * * * *

UNITED STATES PATENT AND TRADEMARK OFFICE

CERTIFICATE OF CORRECTION

PATENT NO. : 4,117,315

DATED : September 26, 1978

INVENTOR(S) : Cornelis Georg Frederik Ampt et al

It is certified that error appears in the above-identified patent and that said Letters Patent are hereby corrected as shown below:

In the Abstract, Page 1, line 1, before "Calculating device" insert - - Radioactive dose - -; Column 2, line 35, after "measurement" insert a comma; Column 4, line 16, change " $\alpha$ " to - - $\Delta$ - - .

Signed and Sealed this

*Third* Day of *April 1979*

[SEAL]

*Attest:*

RUTH C. MASON
*Attesting Officer*

DONALD W. BANNER
*Commissioner of Patents and Trademarks*